United States Patent [19]

Engel

[11] Patent Number: 4,570,105

[45] Date of Patent: Feb. 11, 1986

[54] ELECTRICAL ADAPTER FOR USE IN CONNECTION WITH FLUORESCENT LAMPS

[76] Inventor: Herman J. Engel, 9832 Dungan Rd., Philadelphia, Pa. 19115

[21] Appl. No.: 534,082

[22] Filed: Sep. 20, 1983

[51] Int. Cl.[4] ..... H01J 7/44

[52] U.S. Cl. ..... 315/58; 315/71; 313/318; 336/90; 339/55

[58] Field of Search ..... 315/56, 57, 58, 70, 315/71; 313/318; 339/54, 55, 76, 145 T; 336/90, 107

[56] References Cited

U.S. PATENT DOCUMENTS

| | | | |
|---|---|---|---|
| 2,505,993 | 5/1950 | Rogers | 315/58 |
| 2,655,623 | 10/1953 | Parker | 315/70 |
| 2,807,710 | 9/1957 | Williams | 339/55 X |
| 2,975,386 | 3/1961 | Coy et al. | 336/107 |
| 3,551,736 | 12/1970 | Doehner | 315/100 |
| 3,611,009 | 10/1971 | McNeil | 315/57 |
| 3,815,080 | 6/1974 | Summa | 339/52 R |
| 4,093,893 | 6/1978 | Anderson | 315/48 |
| 4,173,730 | 11/1979 | Young et al. | 315/53 |
| 4,270,071 | 5/1981 | Morton | 315/62 |
| 4,347,460 | 8/1982 | Latassa et al. | 315/63 |
| 4,375,607 | 3/1983 | Morton et al. | 315/56 |
| 4,405,877 | 9/1983 | Haraden et al. | 313/318 |
| 4,414,489 | 11/1983 | Young | 315/51 |
| 4,443,778 | 4/1984 | Mewissen | 336/90 |

FOREIGN PATENT DOCUMENTS

| | | | |
|---|---|---|---|
| 304540 | 3/1955 | Switzerland | 339/55 |

OTHER PUBLICATIONS

Specification sheet entitled "PL Lamp—A Compact Energy Saving Fluorescent Lamp", distributed by the North American Philips Lighting Corporation, printed in the United States in Jul. 1982, (two pages).

Specification sheet entitled "PL TM Adapter—A Compact Screw-in Adapter to Replace Incandescent Lamps", distirbuted by North American Philips Lighting Corporation, printed in the United States in Jan. 1983, (two pages).

*Primary Examiner*—David K. Moore
*Assistant Examiner*—Vincent DeLuca
*Attorney, Agent, or Firm*—Benasutti & Murray

[57] ABSTRACT

An electrical adapter assembly for enabling use of a fluorescent lamp in connection with an incandescent lighting fixture comprises a hollow and cylindrical housing, an Edison-type base extending from one end of the housing and a cover enclosing the end of the housing opposing the base. A toroidal ballast is located within the housing and is capable of receiving portions of the fluorescent lamp within hollow central portions of the ballast to enhance spacial efficiency. The base is either affixed to the housing, or alternatively, is rotatingly associated with the housing to provide a security feature.

18 Claims, 9 Drawing Figures

ELECTRICAL ADAPTER FOR USE IN CONNECTION WITH FLUORESCENT LAMPS

BACKGROUND OF THE INVENTION

The present invention relates generally to electrical adapters, and more particularly, to an electrical adapter which enables a fluorescent lamp to be used in connection with an incandescent lighting fixture.

Lighting applications will generally either make use of a fluorescent lighting fixture or an incandescent lighting fixture, depending upon a wide variety of design considerations. For example, fluorescent lamps are generally more efficient and accordingly require less energy to provide a given amount of lighting. However, the relative complexity of fluorescent lighting fixtures often limits their utility in connection with many applications, particularly those involving limited space. For this reason, particularly in connection with consumer-oriented applications, decorative electrical fixtures generally make use of incandescent lamps to satisfy ordinary spacial and aesthetic requirements. This is, of course, done at the expense of energy considerations.

Recognizing this, efforts have been made to develop a fluorescent lighting assembly which may be used in connection with incandescent lighting fixtures, particularly those having the foregoing design constraints. This is generally accomplished by providing an adapter which incorporates a base for engaging the socket of a conventional incandescent lighting fixture (an Edison-type base), and a body for containing the electrical components necessary to operate a fluorescent lamp. However, again, these electrical adapter assemblies are generally relatively complicated, rather cumbersome, and poor in appearance, limiting their utility. Reasons for this include the size of the fluorescent lamps used, which are generally too large for conventional incandescent lighting fixtures, as well as the size of the adapters which must be used to operate such fluorescent lamps, which often incorporate protruding structures unsuitable for use in connection with conventional incandescent lighting fixtures. In addition, such electrical adapter assemblies generally tend to overheat due to the inefficiency of the components used in connection therewith.

It therefore remains desirable to develop an electrical adapter which enables a fluorescent lamp to be used in connection with an incandescent lighting fixture, yet which is capable of overcoming the foregoing difficulties.

SUMMARY OF THE INVENTION

It is therefore a primary object of the present invention to develop an electrical adapter which enables a fluorescent lamp to be used in connection with an incandescent lighting fixture.

It is also an object of the present invention to develop an electrical adapter which enables a fluorescent lamp to be used in connection with an incandescent lighting fixture and which is sufficiently compact to permit its use in connection with a variety of different fixture designs.

It is also an object of the present invention to develop an electrical adapter which enables a fluorescent lamp to be used in connection with an incandescent lighting fixture and which is efficient, reliable, simple in construction, and inexpensive in cost.

It is also an object of the present invention to develop an electrical adapter which enables commercially available fluorescent lamps to be used in connection with incandescent lighting fixtures.

These and other objects are achieved in accordance with the present invention by providing a compact electrical adapter assembly which incorporates a ballast of improved construction.

The electrical adapter assembly generally comprises a housing for receiving the ballast, a base (Edison-type) extending from one end of the housing, and a cover enclosing the end of the housing opposite the base. The Edison-type base enables use of the electrical adapter assembly in connection with any of a variety of conventionally available lighting fixtures. The cover is adapted to receive and securely engage an appropriate fluorescent lamp within the housing.

Located within the housing and between the base and cover is an annularly shaped ballast. The core of the ballast is formed of a series of wound tape laminations. This core is provided with a transverse gap, and appropriate windings, to form a toroidal ballast which is capable of location within the housing of the electrical adapter assembly. Appropriate electrical connections are provided to complete the assembly.

The resulting assembly is compact, having a diameter which is often equal to or less than the diameter of conventional incandescent bulbs. Moreover, the improved ballast of the present invention enables the base of the fluorescent lamp to be received deep within housing, even within the hollow center of the ballast, developing a minimal distance between the base of the electrical adapter assembly and the base of the fluorescent lamp. As a result, the electrical adapter assembly of the present invention is sufficiently compact to be used in connection with a variety of different lighting applications.

The construction of the ballast of the electrical adapter assembly of the present invention also enables an efficient use of energy to provide a desired luminesence. The amount of heat loss encounterd in connection with the operation of such a unit is significantly reduced, particularly in relation to the heat losses which are currently generally encountered in connection with the operation of conventional ballasts having "E-I" type laminations for example.

For further detail regarding the electrical adapter assembly of the present invention, reference is made to the following detailed description, taken in conjunction with the following illustrations.

BRIEF DESCRIPTION OF THE DRAWINGS

In the several views provided, like reference numerals denote similar structure.

DETAILED DESCRIPTION OF PREFERRED EMBODIMENTS

Figures 1, 2:
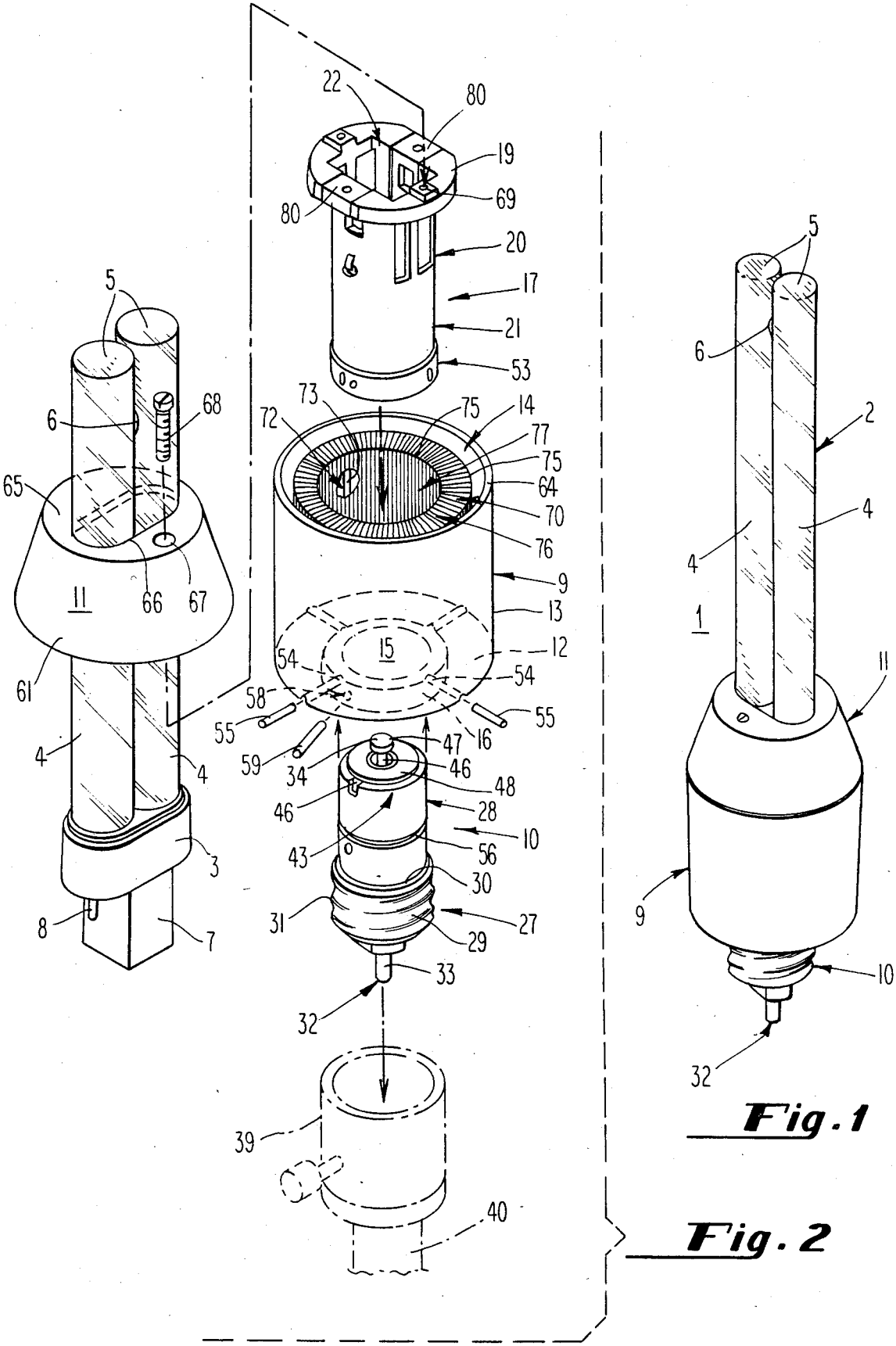
FIG. 1 is a perspective view of an electrical adapter assembly of the present invention, also showing an associated fluorescent lamp.
FIG. 2 is an exploded view of the electrical adapter assembly and associated fluorescent lamp illustrated in FIG. 1, also showing a conventional incandescent lighting fixture.

Although specific forms of the invention have been selected for illustration in the drawings, and the following description is drawn in specific terms for the purpose of describing these forms of the invention, this description is not intended to limit the scope of the invention which is defined in the appended claims.

FIG. 1 illustrates a first embodiment of my electrical adapter assembly 1. In this embodiment, the electrical adapter assembly 1 is used in connection with a fluorescent lamp 2 of the type illustrated, and is provided with a security feature which serves to prevent unauthorized removal of the device (i.e. theft) once installed, as will be more fully described below.

The fluorescent lamp 2 illustrated in the drawings and selected as preferred for use in connection with the present invention is a "PL Lamp" fluorescent lamp manufactured by the North American Philips Lighting Corporation. Such lamps are manufactured in different varieties (including 7, 9 and 13 watt varieties) and conveniently incorporate many of the components necessary for operation of a fluorescent lamp such as the starter and capacitor. Although less preferred, other types of fluorescent lamps could have been selected for use if desired.

With reference to FIG. 2, it will be noted that such "PL Lamp" fluorescent lamps generally include a base 3, and a pair of cylindrical members 4 extending from the base 3 and connected together near their ends 5 by a bridge welding 6. Also associated with the base 3, opposite the cylindrical members 4, are a housing 7 and a pair of contacts 8. The housing 7 contains various electrical components associated with the operation of a fluorescent lamp, including electrodes, a starter and a capacitor. The contacts 8 are used to establish electrical connection between these internally disposed components and the electrical adapter assembly 1 as will be more fully described below. It will be understood that the above described elements may vary in accordance with the rating of the fluorescent lamp 2, particularly the length of the cylindrical members 4. It will also be understood that the foregoing structure does not form part of the present invention, but merely represents a preferred fluorescent lamp for use in connection with the electrical adapter assembly 1 of the present invention.

As is best illustrated in FIGS. 1 and 2, the electrical adapter assembly 1 generally comprises a housing 9 which is essentially cylindrical in shape, a base 10 depending from one end of the housing 9, and a cover 11 associated with the end of the housing 9 opposite the base 10. Further illustration of this structure is provided in FIGS. 2 and 3.

As shown, the housing 9 is generally hollow and includes a bottom portion 12 for receiving the base 10, and a wall portion 13 extending from the bottom portion 12 to define a structure receiving cavity 14. The center of the bottom portion 12 is provided with an aperture 15 surrounded by a depending flange 16, for purposes which will be more fully described below.

Located within the cavity 14 is a frame 17 which is essentially cylindrical in peripheral shape. The frame 17 incorporates an essentially centrally disposed bridge portion 18 and a collar 19 located at the end of the frame 17 which will subsequently receive the fluorescent lamp 2. It will be noted that the bridge portion 18 serves to divide the frame 17 into two sections 20, 21, defining a pair of structure receiving cavities 22, 23 as follows.

Figure 3:
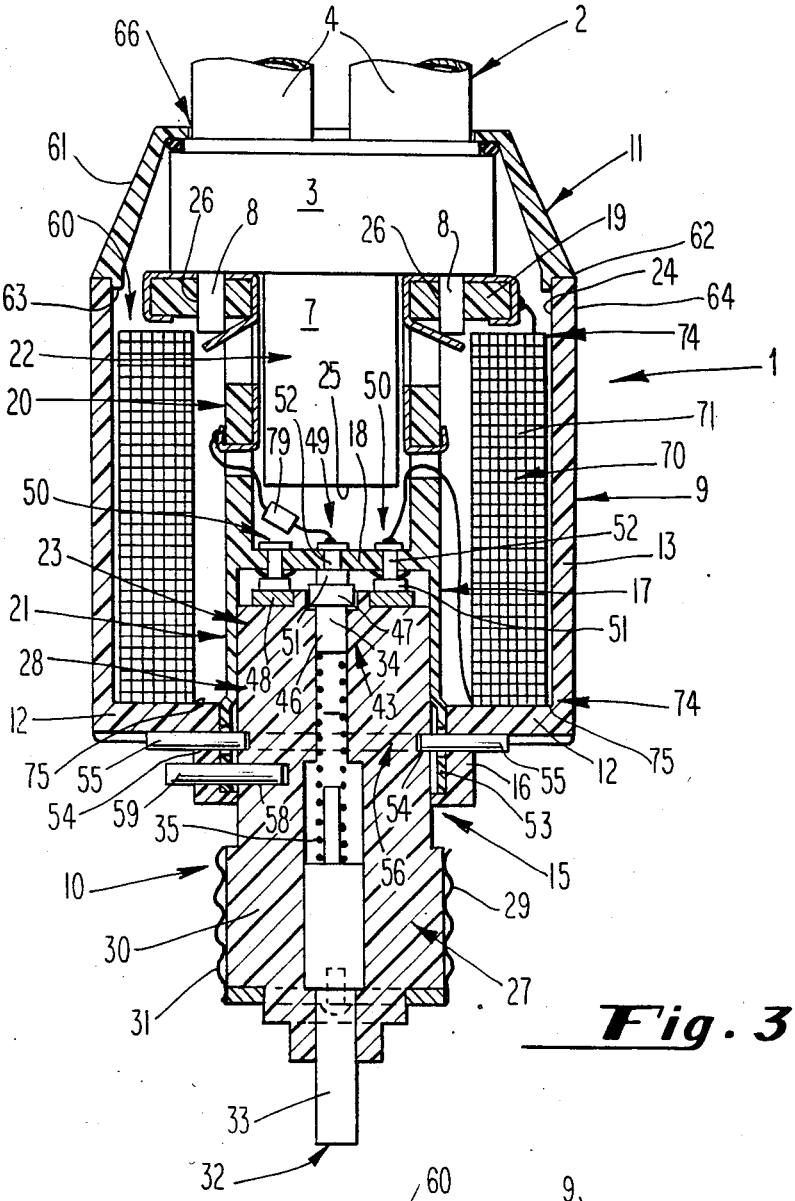
FIG. 3 is a partial, cross-sectional view of the electrical adapter assembly and associated fluorescent lamp illustrated in FIG. 1.
Figure 4:
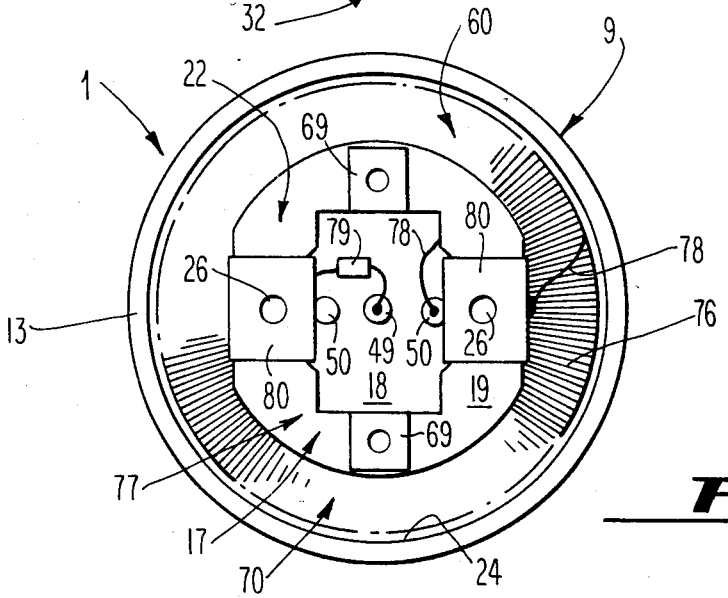
FIG. 4 is a top plan view of the electrical adapter assembly illustrated in FIG. 1, with the cover and fluorescent lamp removed.
Figure 5:
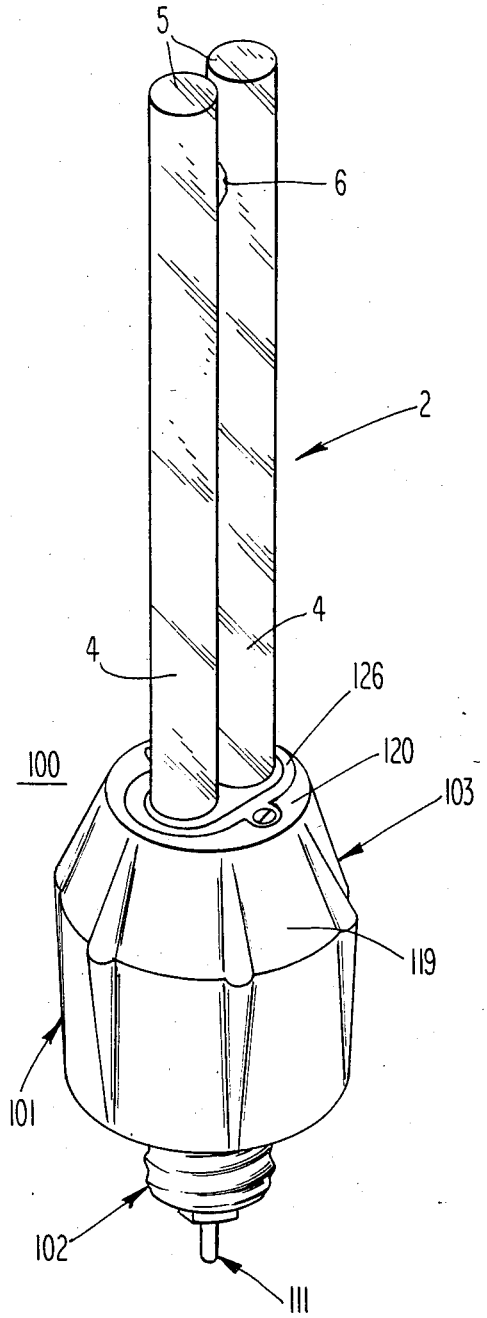
FIG. 5 is a perspective view of another electrical adapter assembly of the present invention, also showing an associated fluorescent lamp.
Figure 6:
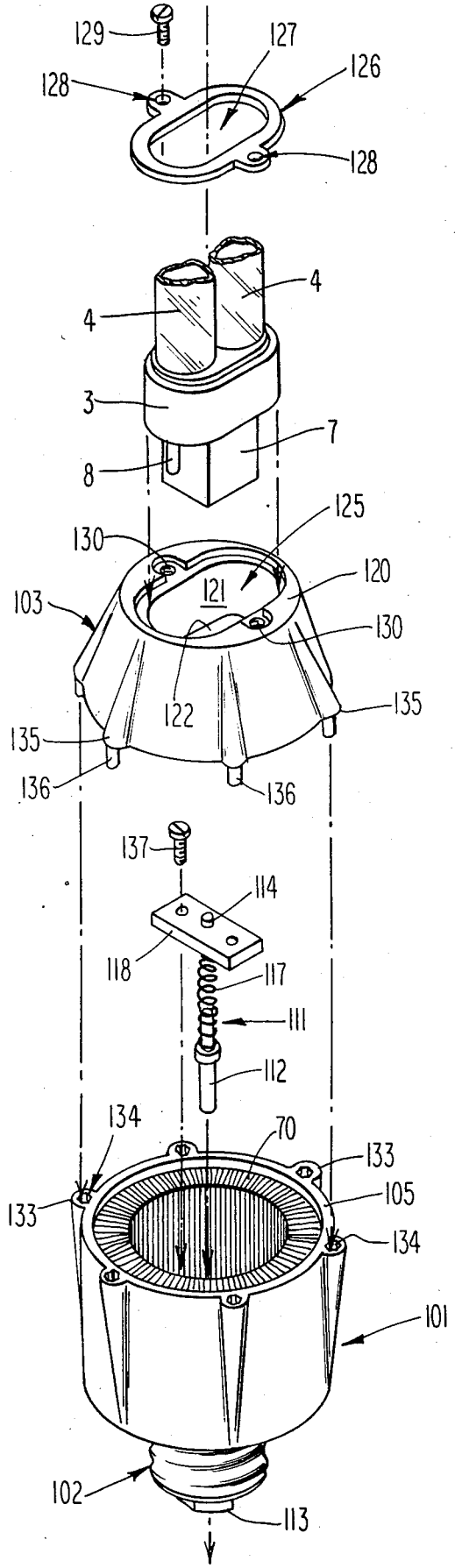
FIG. 6 is an exploded view of the electrical adapter assembly and associated fluorescent lamp illustrated in FIG. 5.
Figure 7:
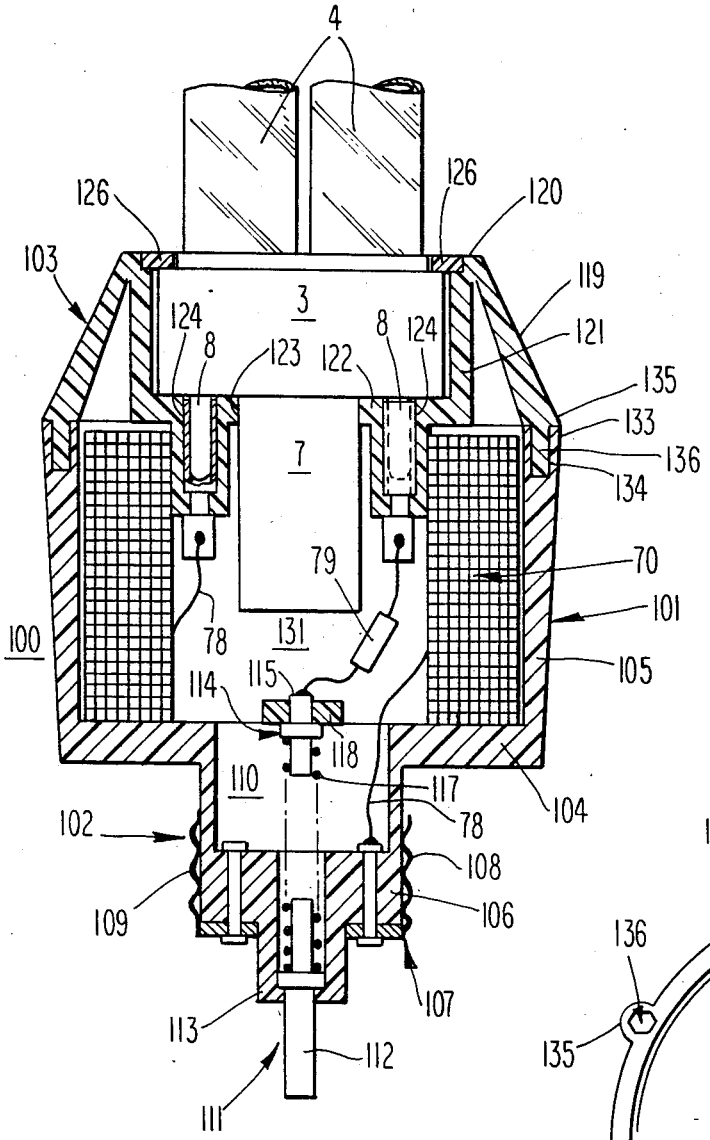
FIG. 7 is a partial, cross-sectional view of the electrical adapter assembly and associated fluorescent lamp illustrated in FIG. 5.

A first, upper cavity 22 is associated with the upper section 20 of the frame 17 and provides a means for subsequently receiving the fluorescent lamp 2. To this end, the walls 24 of the upper section 20 are configured to correspond with and slidingly receive the housing 7 associated with the base 3 of the fluorescent lamp 2. To provide electrical interconnection between the electrical adapter assembly 1 and the received fluorescent lamp 2, as will be more fully described below, the collar 19 is provided with a pair of apertures 26 for receiving the electrical contacts 8 associated with the fluorescent lamp 2. To further facilitate electrical interconnection, the bottom 25 of the housing 7 is spaced from the bridge portion 18 of the frame 17, as is best illustrated in FIG. 3.

A second, lower cavity 23 is associated with the lower section 21 of the frame 17 and provides a means for receiving the base 10 of the electrical adapter assembly 1. In the embodiment illustrated in FIGS. 1–4, the base 10 is adapted to prevent unauthorized removal (i.e. theft) of the electrical adapter assembly 1 from an electrical fixture with which it is associated. To this end, the base 10 generally comprises a conventional "Edison-type" socket member 27 and a cylindrical connector member 28 extending therefrom.

The socket member 27 incorporates a metallic outer member 29 surrounding a core 30 formed of a nonconducting material. The outer member 29 is provided with a series of threads 31 capable of engaging most conventional incandescent lighting fixtures incorporating an "Edison-type" base. Axially extending through the core 30 is an aperture 32 for containing a pair of contact pins 33, 34 and a spring 35 engaging and extending between the contact pins 33, 34.

It will be understood that the spring 35 will continuously bias the contact pin 33 into its fully extended position. As previously indicated, the threads 31 associated with the outer member 29 are capable of engaging a socket 39 of a conventional incandescent lighting fixture 40 (shown in phantom). During this process, the contact pin 33 will be brought into engagement with the center contact 41 associated with the socket 39, completing electrical interconnection between the base 10 of the electrical adapter assembly 1 and the socket 39 of the fixture 40. Of course, the spring 35 will assure that this electrical interconnection is maintained as the socket portion 27 is tightened down within the socket 39, irrespective of the length of the socket 39.

The terminating end 43 of the connector member 28 is provided with a series of communicating electrical contacts, including the contact pin 34. Each such contact incorporates a lug 46 for receiving appropriate electrical connections. The lug 46 associated with the contact pin 34 terminates at a disk 47, while the remaining lugs 46 terminate at an annular ring 48 which is separated from and surrounds the disk 47. Either of the lugs 46 associated with the annular ring 48 are electrically interconnected to the outer member 29. Of course, the contact pin 34 is electrically interconnected to the contact pin 33 through the spring 35.

Cooperating with the electrical contacts of the connector member 28 are a series of contacts 49, 50 associated with the bridge portion 18 of the frame 17. The contacts 49, 50 each include a disk 51 and an associated lug 52. The disk 51 associated with the center contact 49 engages the disk 47 associated with the contact pin 34 of the connector member 28. The disks 51 associated with the contacts 50 simultaneously engage the ring 48 associatd with the outwardly disposed lugs 46 of the connector member 28. This serves to establish electrical interconnection between the lugs 52 of the bridge portion 18 and the socket member 27 of the base 10, while also permitting rotation of the socket member 27 and connector member 28 within the aperture 15 of the housing 9 and the lower cavity 23 associated with the frame 17, as follows.

To retain the frame 17 within the cavity 14 of the housing 9, and over the aperture 15 associatd with its bottom portion 12, the terminating end 53 of the lower section 21 is preferably provided with a plurality of apertures 54 for receiving a plurality of retaining pins 55 associated with the flange 16 of the housing 9. Although the end 53 of the frame 17 could simply be bonded to the bottom portion 12, the foregoing structure is preferred since the retaining pins 55 also serve as a means for engaging a groove 56 associated with the periphery of the connector member 28. This enables rotation of the base 10 with respect to the housing 9 while simultaneously assuring mechanical interconnection between these components.

To enable installation or authorized removal of the electrical adapter assembly 1 within the socket 39 of the fixture 40, the connector member 28 is provided with an aperture 58, and a retaining pin 59 associated with the flange 16 engages the aperture 58 to prevent relative rotation between the base 10 and housing 9. However, removal of the retaining pin 59 from the aperture 58 will enable relative rotation between the base 10 and housing 9, preventing further rotation of the socket member 27 within the socket 39 and thereby preventing unauthorized removal of the electrical adapter assembly 1 from the socket 39. In the latter case, the connector member 28 will freely rotate within the lower cavity 23, electrical interconnection between the socket member 27 and the bridge portion 18 of the frame 17 being maintained by respective engagement between the contacts 49, 50 associated with the bridge portion 18 and the disk 47 and ring 48 associatd with the connector member 28.

To enclose the foregoing assembly, the cover 11 is provided. Face portions 61 of the cover 11 generally form a truncated, conical shape having a terminating edge 62 which essentially corresponds to the wall portion 13 of the housing 9. The terminating edge 62 includes a flange 63 for engaging the periphery 64 of the housing 9, essentially completing the enclosure of the electrical adapter assembly 1.

Upper face portions 65 of the cover 11 incorporate a series of apertures 66, 67. The aperture 66 is configured to receive the cylindrical members 4 of the fluorescent lamp 2, while the apertures 67 receive attachment screws 68 for retaining the cover 11 to the housing 9, preferably by engaging a pair of apertures 69 associated with the collar 19 of the frame 17 (best illustrated in FIG. 4). It will be noted that the resulting distance between the collar 19 of the frame 17 and the upper face portions 65 of the cover 11 essentially corresponds to the height of the base 3 of the fluorescent lamp 2. Accordingly, the above described assembly will not only securely retain the cover 11 to the housing 9, but will also securely retain the base 3 of the fluorescent lamp 2 within the electrical adapter assembly 1.

Assembly of the foregoing structure develops an annular region 60 between the frame 17 and the housing 9, bounded by the collar 19 of the frame 17 and the bottom portion 12 of the housing 9. This annular region 60 is adapted to receive a ballast 70 of improved construction for use in connection with the electrical adapter assembly 1 of the present invention. Formation of such a ballast 70 is generally accomplished as follows. First, a cylindrical core 71 is formed by winding an appropriate metallic tape about a mandrel to form a series of spiral wound laminations. The core 71 is then vacuum impregnated to releave stress and improve lamination uniformity. Thereafter, a longitudinal gap 72 is cut in the core 71, which gap is selected in accordance with known formulas. To maintain the gap 72, a gapping material or glue 73 is applied at the gap 72. Thereafter, the ends 74 of the core 71 are either capped, or the entire unit is dipped in a fluidized epoxy, to insulate the core 71 and eliminate sharpness at the edges 75. Thereafter, an appropriate number of windings 76 of suitable wire are applied to the core 71 to complete the ballast 70. This results in the development of a toroidal ballast 70 capable of location within the annular region 60 as shown. It will be noted that as a result of the configuration of the ballast 70, portions of the fluorescent lamp 2 are capable of location within central portions 77 of the ballast 70, affording a significant improvement in spacial efficiency.

In electrically interconnecting the foregoing components, terminal ends 78 of the windings 76 associated with the ballast 70 are electrically interconnected between one of the contacts 8 associated with the fluorescent lamp 2 and either of the contacts 50 associated with the bridge portion 18 of the frame 17. The remaining contact 8 associated with the fluorescent lamp 2 is electrically connected to the center contact 49 associated with the bridge portion 18 of the frame 17. This latter electrical interconnection is preferably performed by attaching a thermal switch 79 between the center contact 49 and the associated contact 8 of the fluorescent lamp 2 to protect against the possibility of thermal overloading. To facilitate electrical interconnection with the contacts 8 of the fluorescent lamp 2, the upper section 20 of the frame 17 is preferably provided with metallic contact members 80 as shown, It will therefore be seen that suitable electrical interconnection is established between the contacts 8 of the fluorescent lamp 2 and the socket 39 of the fixture 40, enabling operation of the fluorescent lamp 2 in response to the application of conventional line current (e.g. 110 volts, 60 cycles) to the base 10 of the electrical adapter 1.

In connection with many applications of the electrical adapter assembly of the present invention, it will not be necessary to prevent unauthorized removal of the electrical adapter assembly from the electrical fixture with which it is used. Accordingly, in such applications, it will not be necessary to provide the electrical adapter assembly with a security-type base of the type described in connection with the electrical adapter assembly 1 illustrated in FIGS. 1–4. One such electrical adapter assembly 100 is illustrated in FIGS. 5–8.

The electrical adapter assembly 100 illustrated in FIGS. 5–8 again generally incorporates an essentially cylindrically shaped housing 101, a base 102 depending from one end of the housing 101, and a cover 103 associated with the end of the housing 101 opposite the base 102.

The housing 101 again includes a bottom portion 104, and a wall portion 105 extending from the periphery of the bottom portion 104. However, in the present embodiment, the core 106 associated with the base 102 forms part of the bottom portion 104, essentially replacing the flanged aperture 15 previously described in connection with the electrical adapter assembly 1. The periphery 107 of the core 106 is again provided with a metallic outer member 108 having a series of threads 109 associated therewith, and an axially disposed cavity 110 is provided for receiving a center contact 111. The center contact 111 again comprises a lower contact pin 112 extending from the bottom 113 of the core 106, an upper contact pin 114 having a lug portion 115, and a spring 117 extending between the lower contact pin 112 and the upper contact pin 114. However, in the present embodiment, a retainer 118 spans the cavity 110 and engages terminal portions of the upper contact pin 114 to retain the center contact 111 within the cavity 110 and to bias the lower contact pin 112 into its extended position. To this end, the retainer 118 is preferably attached to the bottom portion 104 of the housing 101 using a pair of attachment screws 137.

The cover 103 is again provided with truncated, conical face portions 119 capable of enclosing the housing 101. However, in the present embodiment, the upper portions 120 of the cover 103 also provide a means for receiving the base 3 of a fluorescent lamp 2 of the type previously described. To this end, shaped sides 121 depend from the upper portions 120 of the cover 103 and terminate at a bottom 122 incorporating a plurality of apertures 123, 124. The shaped sides 121 are configured the receive the periphery of the base 3 of the fluorescent lamp 2. The apertures 123, 124 assist in receiving the base 3 of the fluorescent lamp 2 within the resulting cavity 125. For example, the aperture 123 is essentially rectangular and is adapted to receive the housing 7 associated with the fluorescent lamp 2, while the apertures 124 are adapted to receive the contacts 8 associated with the fluorescent lamp 2.

To retain the fluorescent lamp 2 within the cavity 125, a retaining member 126 is provided which includes an aperture 127 configured to surround and receive the cylindrical members 4 of the fluorescent lamp 2, and apertures 128 for receiving attachment screws 129 capable of engaging apertures 130 associated with the upper portions 120 of the cover 103. In use, upon locating the base 3 of the fluorescent lamp 2 within the cavity 125 associatd with the cover 103, the retaining member 126 is secured in position over the base 3 of the fluorescent lamp 2, retaining the fluorescent lamp 2 in position.

Assembly of the housing 101 and cover 103 will define a cavity 131 which is again capable of receiving a ballast 70 of the type previously described in connection with the electrical adapter assembly 1. The ballast 70 is formed as previously described, and is securely retained in position between the bottom 122 of the cover 103 and the bottom portion 104 of the housing 101.

A variety of means may be used to securely attach the cover 103 to the housing 101, including the use of various bonding procedures, or the use of attachment screws extending between the cover 103 and housing 101. However, one attachment means which has been found to be particularly useful in connection with the present assembly is to provide terminal portions 133 of the housing 101 with a series of shaped apertures 134, and to provide terminal portions 135 of the cover 103 with a series of shaped projections 136. Properly mating the apertures 134 and projections 136 will develop an interference fit between the cover 103 and housing 101 which is capable of securely retaining these structures together. In the embodiment illustrated, and as is preferred, such an interference fit is developed by utilizing hexagonal apertures in connection with hemispherical projections. Other combinations may be used if desired.

Electrical interconnection between the various components previously described is accomplished by electrically connecting the ballast 70 between either of the contacts 8 of the fluorescent lamp 2 and the metallic outer member 108 of the base 102. The remaining contact 8 of the fluorescent lamp 2 is electrically connected to the upper contact pin 114, again preferably using a thermal switch 79 as previously described. In this manner, electrical interconnection is established between the base 102 of the electrical adapter assembly 100 and the associated fluorescent lamp 2.

It will therefore be seen that each of the foregoing embodiments serves well to satisfy the objectives previously set forth. The resulting unit is simple in construction, and extremely compact in dimension. Accordingly, each such electrical adapter assembly will be readily adaptable for use in connection with a variety of different types of electrical fixtures.

As previously described, the foregoing electrical adapter assemblies are primarily intended for use in connection with "PL Lamp" fluorescent lamps producing either 7, 9 or 13 watts (or possibly others as well). This will, of course, necessitate variation in the characteristics of the ballast 70. The following examples provide illustrative characteristics of ballasts which have provided adequate operational characteristics in this regard.

EXAMPLE 1

The following ballast was formed for use in connection with either a "PL 7" or a "PL 9" fluorescent lamp of the type manufactured by the North American Philips Lighting Corporation, and in accordance with the present invention.

The core of the ballast was formed of a series of spiral, wound tape laminations. The tape material used had a thickness of 12 mils (10 to 12 mils is preferred), was comprised of 97% iron and 3% silicon (also preferred), and was grain oriented (also preferred). In forming the core, a tape of this type and having a width on the order of $\frac{3}{4}$ of an inch was wound about a mandrel having a diameter of $1\frac{1}{4}$ inches until an outer diameter of $1\frac{3}{4}$ inches was reached. The resulting core was then longitudinally slit and provided with a gap of approximately 75 mils. Approximately twenty-five hundred turns of 32 gauge copper wire (29–32 gauge is preferred) were then applied to the core.

This ballast was found to provide adequate operational characteristics in connection with either the "PL 7" or "PL 9" fluorescent lamp. Particularly noteworthy was a significant reduction in heating (overheating) during operation.

EXAMPLE 2

The following ballast was formed for use in connection with a "PL 13" fluorescent lamp of the type manufactured by the North American Philips Lighting Corporation, and in accordance with the present invention.

The core was prepared similarly to the core described in Example 1, except that the width of the tape used was increased to 1½ inches. The resulting core was then provided with a gap of approximately 27 mils, and approximately 1,060 turns of 30 gauge copper wire.

This ballast was found to provide adequate operational characteristics in connection with the "PL 13" fluorescent lamp. Again, a significant reduction in heating (overheating) was noted during operation.

It will be understood that the foregoing structure is capable of still further variation without departing from the spirit and scope of the present invention.

For example, it is clearly possible to vary the specifications of the ballast to suit a particular application. Preferably, this is accomplished without changing the inner and outer diameter of the core so that the resulting ballast can be placed in a housing which is essentially standard in size. It is also possible for the electrical adapter assembly of the present invention to be used in connection with other types of fluorescent lamps apart from the "PL Lamp" fluorescent lamps previously described, provided the electrical adapter assembly is suitably modified to correctly receive and cooperate with the fluorescent lamp used.

It is also possible to vary the configuration of the housing, cover and base of the electrical adapter assembly, as needed, to permit the electrical adapter assembly to be used in connection with different types of socket bases and electrical fixtures. Clearly, the diameter of the housing may be varied, as needed, although it is preferred that this diameter be kept to a minimum. The diameter of the socket portion of the base may also be varied, as needed, for engagement by electrical sockets of different diameter.

Figure 9:
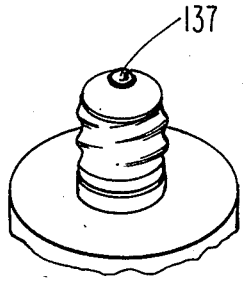
FIG. 9. is a partial, bottom perspective view of an alternative embodiment base for use in connection with the electrical adapter assembly of the present invention.
Figure 8:
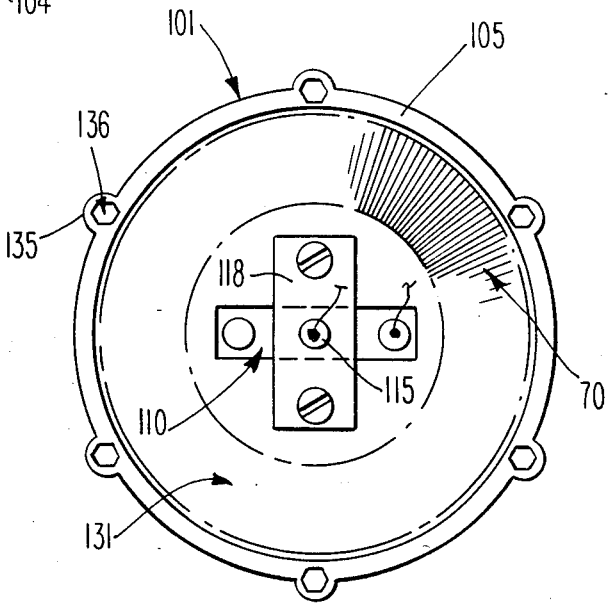
FIG. 8 is a top plan view of the electrical adapter assembly illustrated in FIG. 5, with the retainer and fluorescent lamp removed.

Another possible variation in the configuration of the base of the electrical adapter assembly is illustrated in FIG. 9. As shown, the sliding center contact previously described has been replaced with a stationary center contact 137 to form a base which is essentially similar to the base of a conventional incandescent light bulb. Of course, in such case, appropriate electrical interconnection would be provided between the contact 137 and the remainder of the electrical adapter assembly.

Lastly, it will be understood that the various features described in connection with the electrical adapter assembly 1 illustrated in FIGS. 1–4 may be interchanged with the various features described in connection with the electrical adapter assembly 100 illustrated in FIGS. 4–8, including use of the security-type base 10 versus use of the fixed base 102, use of the cover 11 versus use of the cover 103, the attachment means used in connection therewith, and so on.

It will therefore be understood that various changes in the details, materials and arrangement of parts which have been herein described and illustated in order to explain the nature of this invention may be made by those skilled in the art within the principle and scope of the invention as expressed in the following claims.

What is claimed is:

1. A fluorescent lamp adapter assembly for an incandescent lighting fixture means, comprising:

(a) a hollow housing;

(b) a base member associated with and extending from an end of the housing, and including means for establishing electrical interconnection with the incandescent lighting fixture means, said base member comprising a socket member including a movable center contact means, a biasing means and a fixed outer contact means associated with a non-conducting core, said biasing means engaging the center contact means and the fixed outer contact means;

(c) a cover member associated with and extending from another end of the housing, and including retaining means adapted to retain the fluorescent lamp within the adapter assembly; and (d) an essentially toroidally shaped ballast means located within the housing and between the base member and cover member, and electrically associated in series with the electrical interconnection establishing means of the base member, thereby permitting use of a fluorescent lamp in place of an incandescent light source.

2. The adapter assembly of claim 1 wherein central portions of the ballast means define a cavity, and wherein portions of the fluorescent lamp are capable of being received within said cavity.

3. The adapter assembly of claim 1 wherein the ballast means comprises:

(a) a core formed of a series of spiral, wound tape laminations;

(b) a longitudinal gap developed in the core; and (c) a plurality of windings toroidally applied to the core.

4. The adapter assembly of claim 1 wherein the housing is generally cylindrical.

5. The adapter assembly of claim 4 wherein the cylindrical housing is configured to snugly receive the toroidally shaped ballast means.

6. The adapter assembly of claim 1 wherein the cover member includes face portions having a truncated, generally conical shape.

7. The adapter assembly of claim 6 wherein terminal portions of the cover member include a flange for engaging terminal portions of the housing.

8. The adapter assembly of claim 7 wherein attachment screws secure the cover member to the housing.

9. The adapter assembly of claim 7 wherein interference fit means secure the cover member to the housing.

10. The adapter assembly of claim 1 wherein top portions of the cover member comprise the fluorescent lamp retaining means, and wherein said top portions include an aperture for receiving protruding portions of the fluorescent lamp.

11. The adapter assembly of claim 1 wherein the fluorescent lamp retaining means comprises:

(a) side portions depending from top portions of the cover member;

(b) bottom portions depending from and connecting the side portions, to define a cavity for receiving base portions of the fluorescent lamp; and (c) a retaining member capable of engaging the top portions of the cover member and adapted to retain the base portions of the fluorescent lamp within the receiving cavity.

12. The adapter assembly of claim 1 wherein the electrical interconnection establishing means is an Edison-type socket member.

13. The adapter assembly of claim 1 wherein the movable center contact means comprises a pair of contact members located within a cavity axially disposed within the nonconducting core, and a spring engaging and separating the contact members from one another.

14. The adapter assembly of claim 1 wherein the base member is fixedly associated with the housing.

15. The adapter assembly of claim 1 wherein the base member is capable of rotation relative to the housing.

16. The adapter assembly of claim 15 wherein:

(a) the housing has a flanged aperture for receiving the base member;

(b) the base member has a circumferential groove located in the vicinity of the flange of the aperture; and (c) the flange of the aperture has retaining means associated therewith which slidingly engage the groove of the base member.

17. The adapter assembly of claim 16 wherein a retaining pin associated with the flange of the aperture is capable of selectively engaging an aperture in the base member so that when the retaining pin engages the aperture in the base member, rotation of the base member relative to the housing is prevented, and so that when the retaining pin does not engage the aperture in the base member, rotation of the base member relative to the housing is enabled.

18. The adapter assembly of claim 16 further comprising means for establishing electrical interconnection between the base member and the housing comprising:

(a) a plurality of contact members associated with portions of the housing;

(b) a centrally disposed contact member associated with the base member and adapted for engagement with a corresponding one of the contact members associated with the housing; and (c) a ring member associated with the base member, spaced from and surrounding the centrally disposed contact member associated with the base member, and adapted for engagement with at least one other of the corresponding contact members associated with the housing.

* * * * *